US006884524B2

(12) United States Patent
Ackermann et al.

(10) Patent No.: US 6,884,524 B2
(45) Date of Patent: Apr. 26, 2005

(54) LOW COST CHROME AND CHROME/ ALUMINIDE PROCESS FOR MODERATE TEMPERATURE APPLICATIONS

(75) Inventors: John F. Ackermann, Laramie, WY (US); Paul V. Arszman, Cincinnati, OH (US); Andrew J. Skoog, West Chester, OH (US)

(73) Assignee: General Electric Company, Schenectady, NY (US)

( * ) Notice: Subject to any disclaimer, the term of this patent is extended or adjusted under 35 U.S.C. 154(b) by 97 days.

(21) Appl. No.: 10/330,702

(22) Filed: Dec. 27, 2002

(65) Prior Publication Data

US 2004/0126496 A1 Jul. 1, 2004

(51) Int. Cl.[7] ..... B32B 15/00; B05D 3/02

(52) U.S. Cl. ..... 428/650; 428/651; 428/666; 427/374.1; 427/376.8; 427/380; 427/383.7; 427/405; 427/419.1

(58) Field of Search ..... 427/376.1, 376.6, 427/374.1, 376.8, 379, 380, 383.1, 383.7, 405, 419.1, 419.2; 428/650, 651, 666

(56) References Cited

U.S. PATENT DOCUMENTS 4,451,299 A 5/1984 Smeggil et al.
5,268,045 A 12/1993 Clare
5,514,482 A * 5/1996 Strangman ..... 428/623
5,556,713 A 9/1996 Leverant
5,652,028 A 7/1997 Taylor et al.
5,741,556 A 4/1998 Taylor et al.
5,817,371 A 10/1998 Gupta et al.
5,866,271 A 2/1999 Stueber et al.
5,922,409 A 7/1999 McMordie et al.
6,074,706 A 6/2000 Beverley et al.
6,123,997 A 9/2000 Schaeffer et al.
6,143,141 A 11/2000 Leverant et al.
6,283,714 B1 * 9/2001 Rigney et al. ..... 416/241 R
6,676,992 B1 * 1/2004 Pfaendtner et al. ..... 427/142

FOREIGN PATENT DOCUMENTS

EP 1079002 A1 * 2/2001 ..... C23C/24/08

* cited by examiner

*Primary Examiner*—Bret Chen
(74) *Attorney, Agent, or Firm*—McNees Wallace & Nurick LLC

(57) ABSTRACT

A low cost chromide and chromide/aluminide process for moderate temperature applications. A gas turbine engine component is cleaned and coated with a layer of metal, generally chromium or chromium and aluminum, containing paint. The metal containing paint layer is heated to a first temperature for a first period of time in an air environment to volatilize the solvents in the paint. The metal containing paint layer is heated to a second temperature for a second period of time in an oxygen-free atmosphere to volatilize the solvents in the paint. The now metal layer and component are heated to a third temperature for a third period of time to interdiffuse the metal and the metal of the component. The component and diffusion layer are then cooled to ambient temperature.

19 Claims, 3 Drawing Sheets

LOW COST CHROME AND CHROME/ ALUMINIDE PROCESS FOR MODERATE TEMPERATURE APPLICATIONS

CROSS-REFERENCE TO RELATED APPLICATIONS

This Application is related to application Ser. No. 10/331,054, filed contemporaneously with this Application on Dec. 27, 2002, entitled "LOW COST ALUMINIDE PROCESS FOR MODERATE TEMPERATURE APPLICATIONS" assigned to the assignee of the present invention, and which is incorporated herein by reference.

FIELD OF THE INVENTION

The present invention is directed to a method of forming protective diffusion chromide and chromide/aluminide coatings. More particularly, this invention relates to applying a low cost diffusion chromide or a low cost chromide/aluminide coating.

BACKGROUND OF THE INVENTION

The operating temperature within a gas turbine engine is both thermally and chemically hostile. Significant advances in high temperature capabilities have been achieved through the development of iron, nickel and cobalt-based superalloys and the use of oxidation-resistant environmental coatings capable of protecting superalloys from oxidation, hot corrosion, and other environmental degradation.

In the compressor portion of an aircraft gas turbine engine, atmospheric air is compressed to 10–25 times atmospheric pressure, and adiabatically heated to about 800°–1250° F. (425°–675° C.) in the process. This heated and compressed air is directed into a combustor, where it is mixed with fuel. The fuel is ignited, and the combustion process heats the gases to very high temperatures, in excess of about 3000° F. (1650° C.). These hot gases pass through the turbine, where rotating turbine wheels extract energy to drive the fan and compressor of the engine. The gases then pass into the exhaust system, where the gases supply thrust to propel the aircraft. To improve the efficiency of operation of the aircraft engine, combustion temperatures have been raised. Of course, as the combustion temperatures are raised, steps must be taken to prevent thermal degradation of the materials forming the flow path for these hot gases of combustion.

An aircraft gas turbine engine has a turbine to drive its compressor. In many designs, the turbine is subdivided into a high pressure turbine (HPT) and a low pressure turbine (LPT). The HPT is located just behind the combustor in the engine layout and experiences the highest temperature and pressure levels, nominally 2400° F. (1315° C.) and 300 psia respectively, developed in the engine. The HPT also operates at very high speeds (10,000 RPM for large turbofans, 50,000 for small helicopter engines). In order to meet life requirements at these levels of temperature and pressure, the HPT today is cooled with supplemental air cooling techniques and constructed from advanced alloys.

While a straight turbojet engine will usually have only one turbine (an HPT), most engines today are of the turbofan, either of the high bypass or low bypass type, or turboprop type and require one or two additional turbine(s) to drive a fan or a gearbox. The additional turbines are usually categorized as a Low Pressure Turbine (LPT) and immediately follows the HPT in the engine layout, the turbines typically including a plurality of stages. Since substantial pressure drop occurs across the HPT, as the HPT extracts energy from the hot fluid stream, the LPT operates with a much less energetic fluid and will usually require several stages (usually up to six) to extract additional energy from the stream.

Components formed from iron, nickel and cobalt-based superalloys cannot withstand long service exposures if located in certain sections of a gas turbine engine, where temperature is elevated, such as the LPT and HPT sections. A common solution is to provide such components with an environmental coating that inhibits high temperature oxidation and hot corrosion. Coating materials that have found wide use for this superalloy generally include diffusion aluminide coatings. These coatings are generally formed by such methods as diffusing aluminum deposited by chemical vapor deposition (CVD) or slurry coating into a substrate matrix, or by a diffusion process such as pack cementation, above-pack, or vapor (gas) phase aluminide (VPA) deposition. In the high-pressure stages, aluminum-containing coatings are employed that form stable alumina film. In the low-pressure stages, chromium-containing coatings are favored.

Component surfaces may also have metallic heat rejection coatings, such as platinum. These heat rejection coatings assist in reducing component temperature decrease by effectively reflecting the radiative energy away from the component surface. Accordingly, it is highly desirable to apply these heat rejection coatings to similarly exposed surfaces. However, this is not possible for certain metal alloy parts, such as HPT and LPT components, which may be regularly exposed to temperatures exceeding about 1450° F. (790° C.). In this temperature range, the heat rejection coating interdiffuses with the underlying metallic component surface, or substrate. In essence, a portion of the heat rejection coating material migrates into the component substrate material as elements of the substrate migrate in the opposite direction through the heat rejection coating forming oxides on its surface. This interdiffusion causes the reflective heat rejection surface to become a radiation absorber losing its ability to reflect radiative energy, resulting in a reduction of its ability to decrease component surface temperature, thereby decreasing the service life of the component.

A diffusion chromide or chromide/aluminide coating generally has two distinct zones, the outermost of which is an additive layer containing an environmentally resistant intermetallic generally represented by MCr or MCrAl respectively, where M is iron, nickel, or cobalt, depending on the substrate material. Beneath the additive layer is a diffusion zone comprising various intermetallic and metastable phases that form during the coating reaction as a result of diffusional gradient and changes in elemental solubility in the local regions of the substrate. During high temperature exposure in air, the additive layer forms a protective chromium oxide (chromia) or chromium oxide/aluminum oxide (chromia/alumina) scale or layer that inhibits corrosion, further oxidation, and interdiffusion of the subsequently applied reflective coating and the underlying substrate.

The prior art solutions for applying diffusion chromide or chromide/aluminide coatings including VPA and CVD are complicated, have environmental drawbacks, and are inherently costly. What is needed is a less costly approach to applying diffusion chromide and chromide/aluminide coatings that is more environmentally friendly.

SUMMARY OF THE INVENTION

The present invention is a process for applying a diffusion chromide coating as a barrier coating to a superalloy substrate for use in moderately high temperature applications, such as the superalloy components found in the LPT section of a gas turbine engine. The method includes, after cleaning and masking the surface, as required, first applying a metallic chromium-based layer of paint to the substrate after cleaning the substrate. The layer is allowed to dry. In addition to chromium, this paint includes a carrier material typically an evaporable solvent and a binder, both of which are typically organic. Next, the layer is heated to a first preselected temperature for a first preselected period of time to volatilize any remaining carrier material. The layer is then heated to a second preselected temperature, usually higher than the first preselected temperature, for a second preselected period of time to volatilize and remove the binder portion of the chromium-based paint layer. Depending on the composition of the carrier material and the binder, the first preselected temperature may be the same as the second preselected temperature and the solvent and the binder can be removed in a single step. Next, the layer is heated to a third predetermined temperature above the second preselected temperature, for a third predetermined period of time in the substantial absence of oxygen, without oxidizing the materials at the surface, to diffuse the chromium into the substrate, which creates a protective chromide coating on the substrate that serves as a diffusion barrier between the substrate and subsequently applied coatings such as reflective coatings.

An alternative embodiment of this method includes first applying a layer of paint to the substrate, the paint including both metallic chromium and aluminum. In addition to chromium and aluminum, this paint includes a carrier material and a binder, both of which are typically organic. Next, the layer is heated to a first preselected temperature for a first preselected period of time to volatilize the carrier material. The layer is then heated to a second preselected temperature, usually higher than the first preselected temperature, for a second preselected period of time to burn off and volatilize the binder portion of the chromium-based and aluminum-based paint layer. Depending on the composition of the carrier material and the binder, the first preselected temperature may be the same as the second preselected temperature and the solvent and the binder can be removed in a single step. Next, the layer is heated to a third predetermined temperature, above the second preselected temperature, for a third predetermined period of time in the substantial absence of oxygen to prevent oxidation of chromium and aluminum to diffuse the chromium and aluminum into the substrate, which creates a protective chromide and aluminide coating on the substrate that serves as a diffusion barrier between the substrate and subsequently applied coatings such as reflective coatings.

In additional embodiments, the layer of paint may include any of the following metals, either as elemental particles or as alloys: zirconium; hafnium; platinum; yttrium; silicon; aluminum and zirconium; aluminum and hafnium; aluminum and platinum; aluminum, platinum, and hafnium; aluminum, chromium, and zirconium.

As used herein a "chromide coating" is a coating that contains metallic chromium that is applied to the surface of the substrate in excess of any amount of chromium that may be present in the substrate alloy, and which alloys with elements of the base material substrate. During service, the chromium coating is typically not pure chromium, but includes a concentration of substrate elements as a result of the interdiffusion of the coating materials and the substrate materials at an atomic level. Even where the chromium coating as initially applied is substantially pure chromium, interdiffusion with the substrate typically occurs rapidly as a result of exposure at elevated temperatures. Such interdiffusion during application of the coating or thereafter during a heat treatment or service at elevated temperatures is acceptable and desirable to increase adherence of the coating to the substrate surface.

An advantage of the present invention is a significant labor, capital and materials cost reduction as ultra pure materials and high energy reactors are no longer required. Masking of machined surfaces with aluminum oxide powder or other complex masking is no longer required due to the ability to mask the substrate with simple maskants such as are typically used with painting processes. Another advantage of the present invention is that the process is more environmentally friendly than current practice since heavy metal-based powder waste such as aluminum oxide powder waste and chromium powder waste is reduced.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
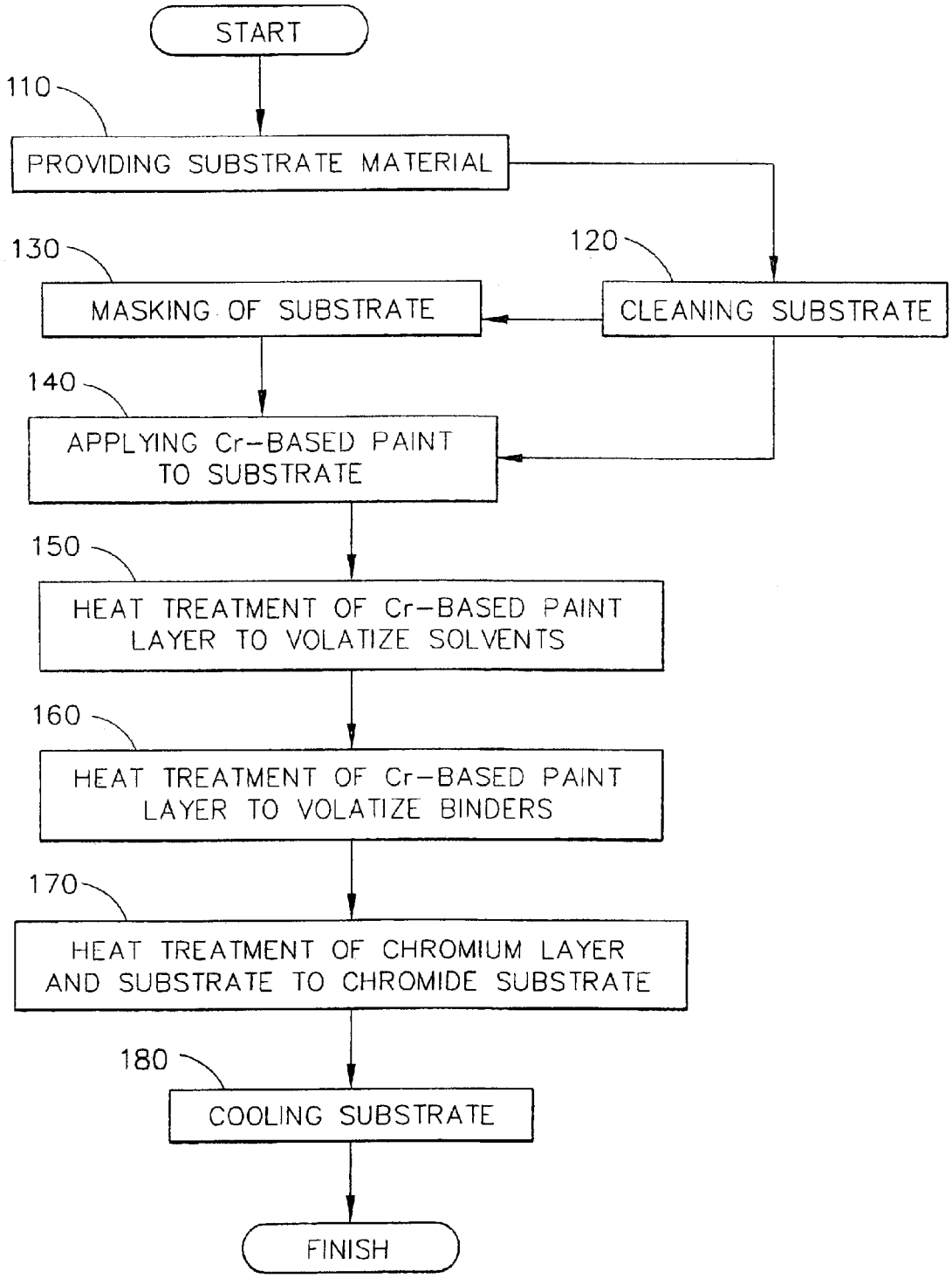
FIG. 1 is a process flow chart illustrating the application of the diffusion chromide coating of the present invention.

Referring now to FIG. 1 there is shown the method of the present invention for applying an chromide coating to an aircraft engine component substrate, at least a portion of which comprises a metallic substrate material. The initial step of the process 110 is the provision of a substrate. After cleaning the substrate of foreign materials such as dirt, oil or undesirable oxides that would interfere with adhesion of subsequently applied coating, as set forth as step 120, the optional next step 130 of the process is masking any preselected portions of the substrate that would be adversely affected by the application of a chromide coating of the present invention. Any conventional masking method used for masking a surface for painting may be used. The cheapest effective method is preferred, such as masking tape. The tape utilized should not employ an adhesive that includes any residues that will detrimentally affect the surface of the substrate or that cannot be readily cleaned. The next step of the process is the application of a layer of a chromium-based paint to the substrate 140 in a manner substantially similar to that employed to apply a coat of paint to an article sufficient to "cover" the article. In a preferred embodiment, the paint is sprayed onto the surface of the substrate to a thickness sufficient to form a substantially continuous layer of chromium on the surface of the substrate. This may require application of a plurality of layers or coats of the paint. The paint layer is of a preselected thickness in the range of about 0.001 inches to about 0.020 inches. In a preferred embodiment, the thickness of the paint layer is about 0.008 inches. While the paint may be applied as a single coat, additional coats may be used to provide a continuous coating or to achieve a desired thickness. Such paint generally contains organic solvents as carriers and binders for adherence in addition to the chromium particles. In a preferred embodiment, the paint is a custom mixed paint containing carriers, binders, and metal particles, where the metal particles are chromium and chromium alloys, although comparable commercially available paints with substantially identical properties from other manufacturers could also be used. The chromium particles in the layer of paint preferably have a platelike morphology that will be substantially oriented parallel to the surface of the substrate. More preferably, the chromium particles are about ½ micron in thickness and are substantially equally distributed within the layer of paint. These particles preferably have an aspect ratio of between about 100:1 to about 10:1, with 20:1 being the most preferred embodiment. However, the size and morphology of the aluminum particles will be dictated by the nozzle opening of the spray paint can. This nozzle opening can be modified if higher aspect particles are required.

After the paint has dried, which usually entails evaporation of a substantial portion of the solvent, the next step of the process is a baking step in an air atmosphere in which the paint layer is heated to a first preselected temperature for a first preselected period of time to volatilize remaining solvents in paint layer 150. The first preselected temperature is generally in the range of about 300° F. (150° C.) to about 485° F. (250° C.), and the first preselected time is in the range about one hour to about three hours depending on the first preselected temperature with shorter times required for more elevated temperatures. In a preferred embodiment, the first preselected temperature is about 400° F. (200° C.) and the first preselected time is about two hours. The next step of the process is a second heat treatment step in which the paint layer is heated preferably in an inert atmosphere and preferably in the absence of oxygen to a second preselected temperature for a second preselected period of time to volatilize the remaining binders in the paint layer 160, which leaves the substrate coated with a layer that is now almost entirely chromium. The second preselected temperature is generally in the range of about 570° F. (300° C.) to about 930° F. (500° C.), and the second preselected time is in the range about one hour to about three hours depending on the second preselected temperature. Again, shorter times are used with higher temperatures. In a preferred embodiment the second preselected temperature is about 750° F. (400° C.) and the second preselected time is about two hours.

The next step of the process is a third heat treatment in which the chromium layer and substrate are heated in the absence of oxygen in an hydrogen reducing or vacuum furnace to a third preselected temperature for a third preselected period of time in an inert or reducing atmosphere such as a reducing atmosphere or an inert gas atmosphere to interdiffuse the chromium and the substrate 170. The protective atmosphere is required to prevent the premature oxidation of chromium that will inhibit its ability to diffuse into the substrate. During the third heat treatment, the third preselected temperature reached and maintained for the duration of the third heat treatment may range from about 1200° F. (650° C.) to about 2010° F. (1100° C.) for a duration of about 1 hour to about 4 hours depending on the third preselected temperature. One having skill in the art realizes that the duration of the third heat treatment also varies depending upon the temperature selected, since the rate of diffusion of chromium and substrate elements is exponentially affected by temperature, for example, the chromium layer and substrate will typically require about 2 hours of exposure at about 1560° F. (850° C.), or about 1 hour of exposure at about 1830° F. (1000° C.) to achieve substantially the same results, i.e., same depth of diffusion of chromium into the substrate. Therefore, any number of heat/exposure combinations may be employed as a matter of manufacturing convenience, so long as the results achieved substantially provide the results of the 1200° F./2010° F. (650° C./1100° C.) exposures just described. In a preferred embodiment, the third heat treatment 170 is performed at a temperature about 1830° F. (1000° C.) for a period of time about 2 hours. Once this third heat treatment has been completed a significant amount of chromium is diffused into substrate. Such chromium diffusion into a metal substrate is well known in the art. However, unlike some prior art processes in which application of chromium is performed at elevated temperatures so that uncontrollable diffusion occurs even as the elemental chromium is applied, the present invention requires a separate heat treatment step to accomplish controllable diffusion. The final step of this process is cooling the substrate to room temperature 180.

Figure 2:
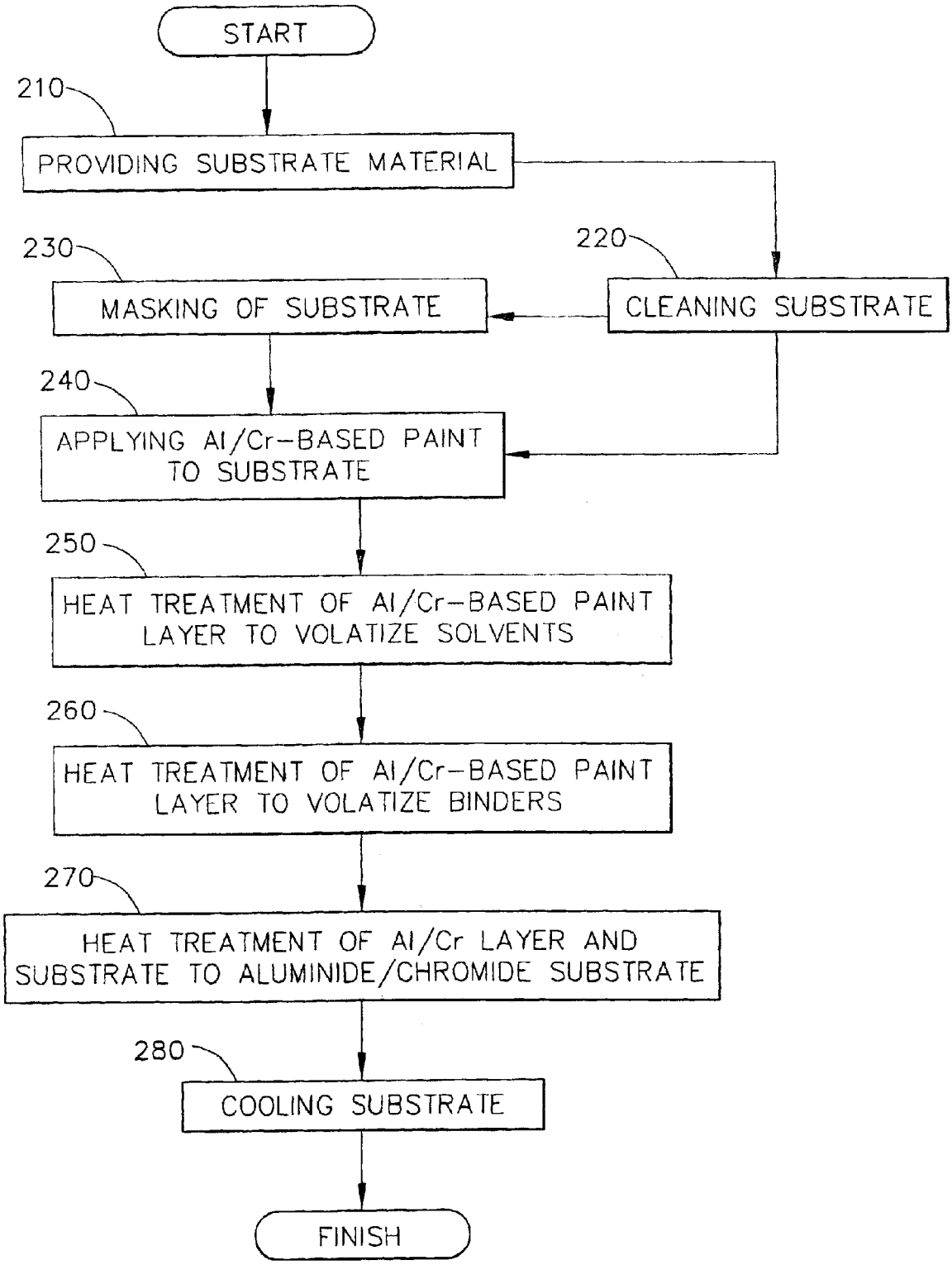
FIG. 2 is a process flow chart illustrating the application of the diffusion chromide/aluminide coating of the present invention.

Referring now to FIG. 2 there is shown the method of the present invention for applying an aluminide and chromide coating to an aircraft engine component substrate, at least a portion of which comprises a metallic substrate material. The initial step of the process 210 is the provision of a substrate. After cleaning the substrate, as set forth as step 220, the optional next step 230 of the process is masking any preselected portions of the substrate that would be adversely affected by the application of an aluminum and chromide coating of the present invention. Any conventional masking method used for masking a surface for painting may be used. The cheapest effective method is preferred, such as masking tape. The tape utilized should not employ an adhesive that includes any residues that will detrimentally affect the surface of the substrate or that cannot be readily cleaned. The next step of the process is the application of a layer of an aluminum-based and chromium-based paint to the substrate 240 in a manner substantially similar to that employed to apply a coat of paint to an article sufficient to encapsulate the article. In a preferred embodiment, the paint is sprayed onto the surface of the substrate to a thickness sufficient to form a substantially continuous layer on the surface of the substrate. This may require application of a plurality of layers or coats of the paint. The paint layer is of a preselected thickness in the range of about 0.001 inches to about 0.020 inches. In a preferred embodiment, the thickness of the paint layer is about 0.008 inches. Such paint generally contains organic solvents as carriers and binders for adherence in addition to the aluminum. In a preferred embodiment, the paint is a custom mixed paint containing carriers, binders, and metal particles, where the metal particles are aluminum and chromium. In a preferred embodiment, the metal solids are about 5% to about 25% weight percent chromium, with the remainder of the metal particles being aluminum. In a more preferred embodiment, the metal particles are about 20% chromium. The metal particles may be separate aluminum particles and chromium particles mixed together and blended in the paint or the metal particles may be a chromium-aluminum alloy. Comparable commercially available paints from other manufacturers could also be used. The aluminum and chromium particles, or chromium aluminum alloy particles, in the layer of paint preferably have a platelike morphology that will be substantially oriented parallel to the surface of the substrate. More preferably, the aluminum and chromium, or chromium aluminum alloy, particles are about 0.5 microns in thickness and are substantially equally distributed within the layer of paint. These particles preferably have an aspect ratio of between about 100:1 to about 10:1, with 20:1 being the most preferred embodiment.

The next step of the process is a baking step in which the paint layer is heated in an air atmosphere to a first preselected temperature for a first preselected period of time to volatilize the solvents in the paint layer 250. The first preselected temperature is generally in the range of about 300° F. (150° C.) to about 485° F. (250° C.), and the first preselected time is in the range about one hour to about three hours depending on the first preselected temperature, with shorter times required for more elevated temperatures. In a preferred embodiment, the first preselected temperature is about 400° F. (200° C.) and the first preselected time is about two hours. The next step of the process is a second heat treatment step in which the paint layer is heated preferably in an inert atmosphere and preferably in the absence of oxygen to a second preselected temperature for a second preselected period of time to burn off and volatilize the remaining binders in the paint layer 260, which leaves the substrate coated with a layer that is now almost entirely aluminum and chromium. The second preselected temperature is generally in the range of about 570° F. (300° C.) to about 930° F. (500° C.), and the second preselected time is in the range about one hour to about three hours depending on the second preselected temperature. Again, shorter times are used with higher temperatures. In a preferred embodiment the second preselected temperature is about 750° F. (400° C.) and the second preselected time is about two hours.

The next step of the process is a third heat treatment in which the aluminum and chromium layer and substrate are heated in an hydrogen reducing or vacuum furnace to a third preselected temperature for a third preselected period of time in a protective atmosphere such as a reducing atmosphere or an inert gas atmosphere to interdiffuse the aluminum and chromium and the substrate 270. The protective atmosphere is require to prevent the premature oxidation of chromium and aluminum which will inhibit its ability to diffuse into the substrate. During the third heat treatment, the third preselected temperature reached and maintained for the duration of the third heat treatment may range from about 1200° F. (650° C.) to about 1830° F. (1000° C.) for a duration of about 1 hour to about 4 hours depending on the third preselected temperature. One having skill in the art realizes that the duration of the third heat treatment also varies depending upon the temperature selected, since the rate of diffusion of aluminum, chromium and substrate elements is exponentially affected by temperature, for example, the aluminum and chromium layer and substrate will typically require about 3 hours of exposure at about 1300° F. (700° C.), or about 1 hour of exposure at about 1600° F. (870° C.) to achieve substantially the same results, i.e., same depth of diffusion. In a preferred embodiment, the third heat treatment 270 is performed at a temperature about 1600° F. (870° C.) for a period of time about 2 hours. Therefore, any number of heat/exposure combinations may be employed as a matter of manufacturing convenience, so long as the results achieved substantially mirror the results of the 1200° F./1830° F. (650° C./1000° C.) exposures just described. Once this third heat treatment has been completed a significant amount of chromium and aluminum is diffused into substrate. Such aluminum and chromium diffusion into a metal substrate is well known in the art. However, unlike some prior art processes in which application of chromium and/or aluminum is performed at elevated temperatures so that diffusion occurs even as the elemental chromium and aluminum is applied, the present invention requires a separate heat treatment step to accomplish diffusion. The final step of this process is cooling the substrate to room temperature 260.

In alternative embodiments, the layer of paint may include any of the following metals, either as elemental particles or as alloys: zirconium; hafnium; platinum; yttrium; silicon; aluminum and zirconium; aluminum and hafnium; aluminum and platinum; aluminum, platinum, and hafnium; aluminum, chromium, and zirconium. For such elemental particles or alloys, the paint may be custom manufactured to appropriate compositions. The remaining steps of the process are identical to the process steps set forth above.

Figure 3:
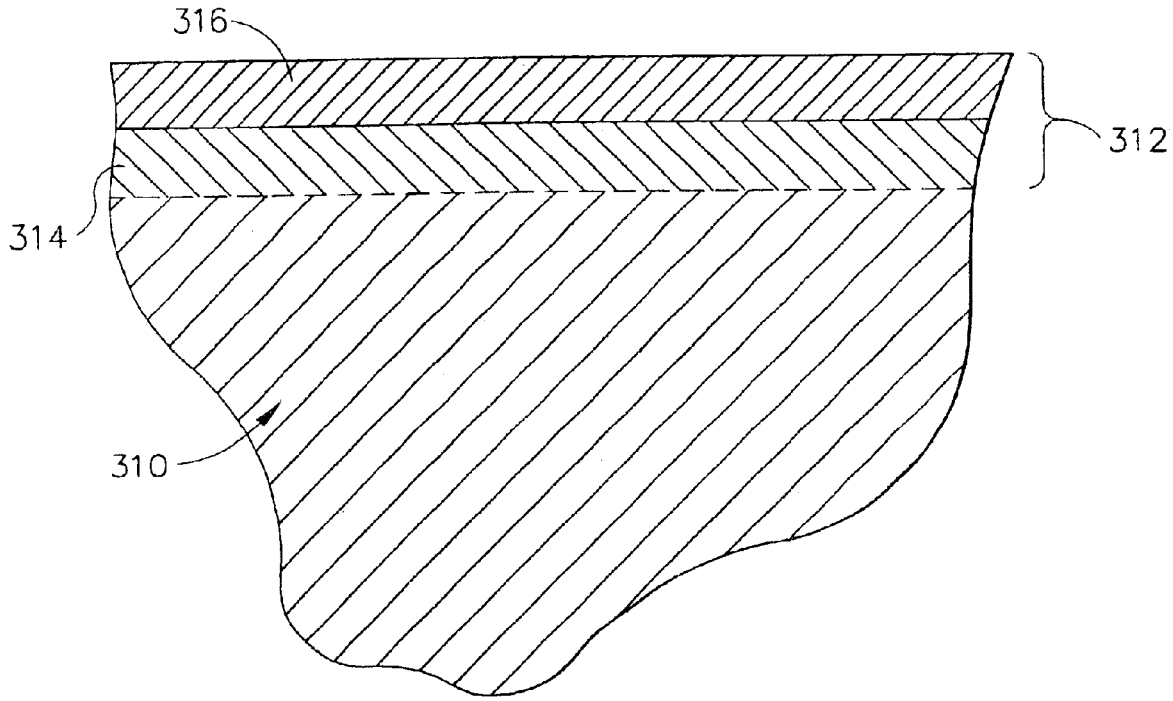
FIG. 3 is a cross-sectional view of a substrate with a diffusion chromide/aluminide coating applied with the method of the present invention.

FIG. 3 represents a diffusion chromide coating 312 that can be produced by the method of this invention. The coating 312 is shown as overlying a substrate 310, which is typically the base material of the component protected by the coating 312. Typical material for the substrate 310 (and therefore the component) include nickel, iron and cobalt-base superalloys, though other alloys could used. The chromium coating 312 is generally characterized by an additive layer 316 that overlies a diffusion zone 314, the former of which contains an oxidation-resistant MCr intermetallic phase. For example, a component comprised of the Rene 41 superalloy coated with the chromide coating of the present invention contains an NiCr intermetallic phase. The additive layer 316 may also contain other intermetallic phases, depending on whether other metals were deposited or otherwise present on the substrate 310 prior to chromiding. For example, the additive layer 316 may include platinum in solution in the MCr later if platinum was plated on the substrate 310. Such diffusion chromide coatings form an chromia scale (not shown) on their surface during exposure to engine environments. The oxide scale inhibits oxidation of the chromide coating 312 and substrate 310. A suitable thickness for the coating 312 is typically about 25 to 250 micrometers (about 0.001–0.010 inch) A reflective or corrosion resistant coating (not shown), such as platinum may be deposited over the chromide coating.

The coatings created by the present invention also form a diffusion barrier to protect subsequently applied coatings such as platinum reflective coatings. This means that the chromide and chromide/aluminide coatings created by the present invention inhibit the reflective coatings from interdiffusing into the substrate material. For example, if a platinum layer is applied to the surface of the chromide or chromide/aluminide layer created by the present invention, the platinum will not interdiffuse with the chromia or chromia/alumina coating when the coated substrate is exposed to a high temperature environment such as a gas turbine engine environment.

The coatings created by the present invention also form a corrosion barrier to protect subsequently applied coatings such as platinum reflective coatings. This means that the chromide and chromide/aluminide coatings created by the present invention prevent reactive chemicals from diffusing into the substrate material. For example, if a corrosive oxide eutectic layer is applied to the surface of the chromide or chromide/aluminide layer created by the present invention, the eutectic will not diffuse through the chromia or chromia/alumina coating when the coated substrate is exposed to a high temperature environment.

Testing of a coupon, typically lengths of material approximately one inch in diameter, aluminided by the method of the present invention have been conducted. For the present invention, a coupon of HS 188 alloy was coated with a single coat of paint that contains both aluminum and chromium. The surface preparation was a standard solvent and water wash. The coupon was heated to about 390° F. (200° C.) and held at that temperature for a period of about two hours to volatilize the solvents in the paint layer. The coupon was then heated to about 750° F. (400° C.) and held at that temperature for a period of about two hours to bum off and volatilize the binders in the paint layer. The coupon was then placed in a hydrogen reducing furnace and heated to a temperature of about 1875° F. (1025° C.) for one hour in order to diffuse the aluminum and chromium in the paint layer into the coupon, creating an aluminide and chromide layer on the surface of the coupon. The coupon was then cooled to room temperature and visually inspected. The portion of the coupon where the aluminide and chromide layer was still present appeared to have no change after exposure to the hot atmosphere.

While the present invention has been described as a method for applying a chromide or a chromide/aluminide coating to a metal substrate generally, the present invention can be applied to any moderate temperature jet aircraft engine component surface along the gas flow path of the engine. In this context, a moderate temperature jet aircraft component surface means any component surface that normally encounters temperatures in the range of about 800° F. to 1400° F. (450° C. to 800° C.). For example, chromide or chromide/aluminide process of the present invention can be applied to LPT engine components or HPT gas turbine components.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for applying a diffusion barrier coating to a substrate comprising the steps of:

providing a metal substrate;

cleaning the substrate of foreign material;

coating the metal substrate with a layer of chromium containing paint, said paint comprising substantially chromium, solvents, and binders;

baking the layer of chromium containing paint to a temperature for a period of time sufficient to volatilize the solvents in the layer of chromium containing paint;

baking the layer of chromium containing paint to a second temperature for a second period of time sufficient to volatilize the binders in the layer of chromium containing paint, the remaining layer being substantially contiguous on the substrate surface and comprising substantially chromium of sufficient thickness;

heating the metal substrate and layer of chromium to a third temperature for a third period of time sufficient to diffuse the chromium into the substrate to form a diffusion chromium layer; and cooling the substrate.

2. The method of claim 1 further comprising the step of applying an outer coating over the diffusion metal layer after cooling the substrate.

3. A low pressure turbine blade coated with a diffusion barrier using the method of claim 2.

4. The method of claim 1 wherein the first temperature is in the range of about 300° F. to about 485° F., the first time is in the range of about one hour to about three hours, the second temperature is in the range of about 750° F. to about 930° F., the second time is in the range of about one hour to about three hours, the third temperature is in the range of about 1200° F. to about 2010° F. and the third time is in the range of about one hour to about four hours.

5. The method of claim 4 wherein the first temperature is about 400° F., the first time is about two hours, the second temperature is about 750° F. and the second time is about two hours, the third temperature is about 1830° F. and the third time is about two hours.

6. The method of claim 5 further comprising the step of applying an outer coating over the diffusion metal layer after cooling the substrate.

7. A low pressure turbine blade coated with a diffusion barrier using the method of claim 6.

8. A high pressure turbine blade coated with a diffusion barrier using the method of claim 6.

9. A low pressure turbine blade coated with a diffusion barrier using the method of claim 1.

10. A high pressure turbine blade coated with a diffusion barrier using the method of claim 1.

11. A method for applying a diffusion barrier coating to a substrate comprising the steps of:

providing a metal substrate;

cleaning the substrate of foreign material;

coating the metal substrate with a layer of chromium and aluminum alloy containing paint, wherein the percentage of the metal that is chromium is in the range of about 5 weight percent to about 25 weight percent, said paint comprising substantially chromium and aluminum alloy, solvents, and binders;

baking the layer of chromium and aluminum alloy containing paint to a temperature for a period of time sufficient to volatilize the solvents in the layer of chromium and aluminum alloy;

baking the layer of chromium and aluminum alloy containing paint to a second temperature for a second period of time sufficient to volatilize the binders in the layer of chromium and aluminum alloy containing paint, the remaining layer being substantially contiguous on the substrate surface and comprising substantially chromium and aluminum alloy of sufficient thickness;

heating the metal substrate and layer of chromium and aluminum alloy to a third temperature for a third period of time sufficient to diffuse the chromium and aluminum alloy into the substrate to form a diffusion chromium and aluminum layer; and cooling the substrate.

12. The method of claim 11, wherein the percentage of the alloy that is chromium is about 20 weight percent.

13. The method of claim 12 wherein the first temperature is in the range of about 300° F. to about 485° F., the first time is in the range of about one hour to about three hours, the second temperature is in the range of about 750° F. to about 930° F., the second time is in the range of about one hour to about three hours, the third temperature is in the range of about 1200° F. to about 1830° F. and the third time is in the range of about one hour to about four hours.

14. The method of claim 13 wherein the first temperature is about 400° F., the first time is about two hours, the second temperature is about 750° F. and the second time is about two hours, the third temperature is about 1600° F. and the third time is about two hours.

15. The method of claim 14 further comprising the step of applying an outer coating over the diffusion metal layer after cooling the substrate.

16. The method of claim 11 wherein the first temperature is in the range of about 300° F. to about 485° F., the first time is in the range of about one hour to about three hours, the second temperature is in the range of about 750° F. to about 930° F., the second time is in the range of about one hour to about three hours, the third temperature is in the range of about 1200° F. to about 1830° F. and the third time is in the range of about one hour to about four hours.

17. The method of claim 16, wherein the first temperature is about 400° F., the first time is about two hours, the second temperature is about 750° F. and the second time is about two hours, the third temperature is about 1600° F. and the third time is about two hours.

18. A low pressure turbine blade coated with a diffusion barrier using the method of claim 11.

19. A high pressure turbine blade coated with a diffusion barrier using the method of claim 11.

* * * * *

UNITED STATES PATENT AND TRADEMARK OFFICE

CERTIFICATE OF CORRECTION

PATENT NO. : 6,884,524 B2
DATED : April 26, 2005
INVENTOR(S) : Ackermann et al.

It is certified that error appears in the above-identified patent and that said Letters Patent is hereby corrected as shown below:

Column 9,
Line 7, “bum” should be -- burn --.

Signed and Sealed this

Seventh Day of February, 2006

JON W. DUDAS
*Director of the United States Patent and Trademark Office*